United States Patent [19]

Pflieger

[11] Patent Number: 5,056,282

[45] Date of Patent: Oct. 15, 1991

[54] INJECTION HOSE FOR JOINTS TO BE SEALED IN CONCRETE WORKS

[76] Inventor: Lieselotte Pflieger, Eichenweg 3, 7405 Dettenhausen, Fed. Rep. of Germany

[21] Appl. No.: 572,756

[22] Filed: Aug. 23, 1990

[30] Foreign Application Priority Data

Sep. 8, 1989 [DE] Fed. Rep. of Germany ..... 3929848

[51] Int. Cl.[5] ..... E04H 14/00

[52] U.S. Cl. ..... 52/173 R; 138/97; 138/98

[58] Field of Search ..... 52/127.3, 127.4, 743, 52/744, 173; 222/494; 138/97, 98; 405/154, 43, 45

[56] References Cited

U.S. PATENT DOCUMENTS

| | | | |
|---|---|---|---|
| 3,427,810 | 1/1966 | Petersen | 405/43 |
| 4,499,925 | 2/1985 | Kaufman | 138/97 |
| 4,723,579 | 2/1988 | Hyodo et al. | 138/98 |

FOREIGN PATENT DOCUMENTS 8425518 11/1984 Fed. Rep. of Germany .

OTHER PUBLICATIONS 0 199 108, Europäische Patentschrift, K. Koob, filed Mar. 21, 1986.

*Primary Examiner*—Richard E. Chilcot, Jr.
*Assistant Examiner*—Wynn E. Wood
*Attorney, Agent, or Firm*—Michael J. Striker

[57] ABSTRACT

An injection hose for joints to be sealed in concrete works comprises a flexible, liquid-impermeable supply hose element for injection fluid and having an injection region provided with a plurality of radial openings, and an envelope hose element composed of liquidtight material and tightly surrounding the supply hose element at least in the injection region. The envelope hose is composed of an elastically expansible material and provided with radial openings which are offset relative to the radial openings of the supply hose.

5 Claims, 1 Drawing Sheet

INJECTION HOSE FOR JOINTS TO BE SEALED IN CONCRETE WORKS

BACKGROUND OF THE INVENTION

The present invention relates to an injection hose for joints to be sealed in concrete works. More particularly, it relates to an injection hose which has flexible, fluid-permeable supply hose for an injection fluid and provided with radial openings in an injection region, and an envelope hose composed of fluid-tight material and tighlty surrounding the supply hose at least in the injection region.

Injection hoses of the above mentioned general type must provide exit of an injection fluid under pressure to prevent entrance of the concrete particles or concrete mass from outside into the injection hose. Some known injection hoses are disclosed for example in the patent documents EP-PS 199,108, and DE-Gm 8,425,518. They operate with closing bodies which are compressible under the pressure of the injection fluid from radial openings. They are expensive both in manufacture as well as due to materials used. An injection hose is also known, in which the fluid-tight outer sleeve must be broken under pressure of the injection fluid at certain locations. This expensive injection hose does not guarantee however the desired seal in many cases, since the outer sleeve tears off frequently not on the desired location or on all desired locations. Moreover, material can enter the injection hose from outside at the torn off locations.

SUMMARY OF THE INVENTION

Accordingly, it is an object of the present invention to provide an injection hose of the above mentioned general type which avoids the disadvantages of the prior art.

More particularly, it is an object of the present invention to provide an injection hose of the above mentioned type, which is formed so that it is price favorable in its production and also reliably prevents an exit of the injection fluid in the whole injection region.

In keeping with these objects and with others which will become apparent hereinafter, one feature of the present invention resides, briefly stated, in that the surrounding sleeve or outer hose element is composed of an elastically expansible material which also has radial openings, and the radial openings of the outer hose are offset relative to the radial openings of the inner supply hose.

In the inventive injection hose the radial openings of the tightly abutting surrounding sleeve are separated from the radial openings of the inner supply sleeve by abutment regions. Under the pressure of the injection fluid, the surrounding sleeve is lifted at locations corresponding to the radial openings of the supply sleeve as a result of an elastic deformation. Therefore, the previously mentioned abutment regions vanish and the injection fluid passes from the supply hose through its radial openings to the radial openings of the outer sleeve.

In accordance with another advantageous feature of the present invention, the throughgoing cross-section of the radial openings of the supply hose per unit peripheral surface of the injection hose is greater than the total throughgoing cross-section of the openings of the outer sleeve. This can be achieved by different diameters of the openings or by different number of openings in the supply hose and in the outer sleeve.

The injection hose made in accordance with the present invention can be produced with low cost. The pulling of the abutting outer sleeve onto the supply sleeve and avoiding the overlapping of the radial openings of both sleeve elements can be performed without problems and without high machine costs. The smaller throughgoing surface of the outer sleeve relative to the throughgoing surface of the supply sleeve provides for a uniform injection fluid exit through the total periphery of the hose and the injection region. The use of compressible porous closing bodies or coating surfaces is therefore dispensed with.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
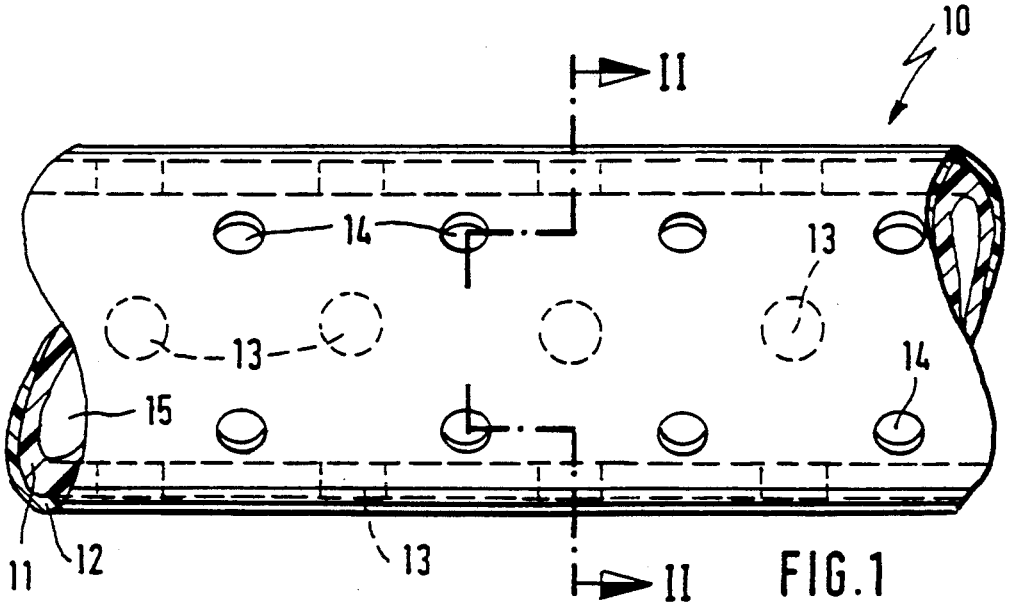
FIG. 1 is a side view of a portion of an injection hose in accordance with the present invention.
Figure 2:
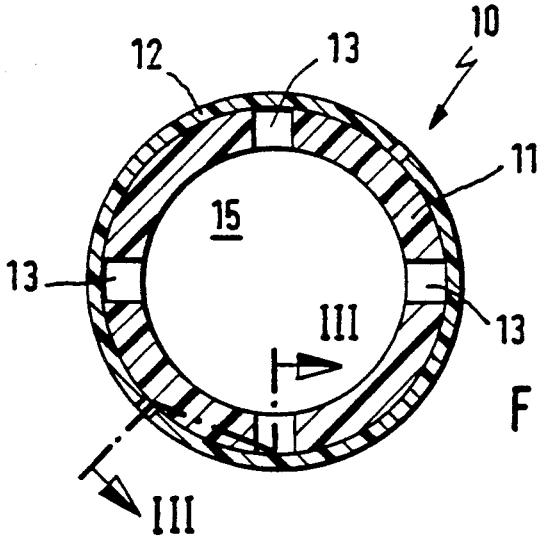
FIG. 2 is a view showing a cross-section of the injection hose in accordance with the present invention taken along line II—II in FIG. 1.

An injection hose in accordance with the present invention is identified as a whole with reference numeral 10. As can be seen more clearly from FIG. 2, it has an inner supply hose 11 composed of a bendable or elastically bendable liquid impermeable material. For example, a synthetic plastic material can be used. The supply hose 11 is surrounded by a thin-walled envelope hose 12. The envelope hose 12 tightly abuts against the outer side of the supply hose 11 and produced from an elastically expansible material.

The supply hose 11 is provided with a plurality of radial throughgoing openings 13. The openings 13 are arranged in a row and spaced from one another. The outer envelope hose 12 also has a plurality of throughgoing openings 14 which are arranged in a row and spaced from one another. The throughgoing openings 14 of the envelope hose 12 are offset relative to the throughgoing openings 13 of the supply hose.

The number of the throughgoing openings 13 and 14 and their distribution over the periphery of the injection hose can be arbitrary. In the shown embodiment the injection hose has a uniform peripheral distribution of the throughgoing openings. Moreover, the throughgoing openings 13 of the supply hose 11 have a greater diameter than the throughgoing openings 14 of the envelope hose 12.

Figure 3:
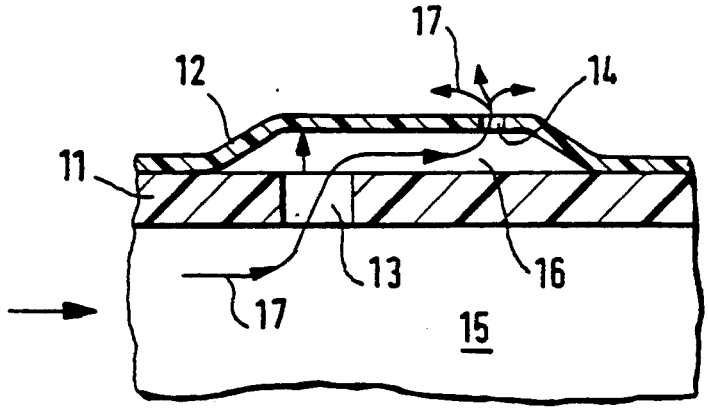
FIG. 3 is a view showing a partial section of the injection hose taken along the line III—III in FIG. 2.

When an injection fluid, for example concrete milk (slurry) is supplied under pressure into the inner chamber 15 of the supply hose 11, the injection fluid in the region of the throughgoing openings 13 of the supply hose 11 applies a pressure onto the tightly abutting envelope hose 12. At these locations the envelope hose 12 bulges due to its elastic property as shown in FIG. 3. As a result of the bulging, connecting chambers 16 are produced between the throughgoing openings 13 of the supply hose 11 and the throughgoing openings 14 of the envelope hose 12. The injection fluid flows through the connecting chambers 16 through the throughgoing openings 14 of the outer envelope sleeve 12 and discharge outwardly as identified by arrow 17 in FIG. 3. As long as the pressure in the inner chamber 15 of the supply hose 11 is eliminated, the outer envelope hose 12 again abuts against the supply hose 11 due to its elasticity. Thereby a return flow of fluid from outside through the throughgoing openings 13 of the liquid-impermeable supply hose 11 is prevented.

It will be understood that each of the elements described above, or two or more together, may also find a useful application in other types of constructions differing from the types described above.

While the invention has been illustrated and described as embodied in an injection hose, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An injection hose for supplying an injection fluid for sealing of joints in concrete works, comprising a flexible, liquid-impermeable supply hose element adapted to supply an injection fluid, said supply hose having an injection region provided with a plurality of radial openings; and an envelope hose element composed of liquid-tight material and tightly surrounding said supply hose element at least in said injection region, said envelope hose being composed of an elastically expansible material and provided with radial openings which are offset relative to said radial openings of said supply hose.

2. An injection hose as defined in claim 1, wherein said radial openings of said supply hose element has a total throughgoing cross-section per unit peripheral surface which is greater than a total throughgoing cross-section of said openings of said envelope hose element.

3. An injection hose as defined in claim 1, wherein said throughgoing openings of said supply hose element have a diameter which is smaller than a diameter of said throughgoing openings of said envelope hose element.

4. An injection hose as defined in claim 1, wherein said radial openings of at least one of said hose elements are uniformly distributed over a periphery of the injection hose.

5. An injection hose as defined in claim 1, wherein said radial openings of said supply hose element and said radial openings of said envelope hose element are uniformly distributed over a periphery of the injection hose.

* * * * *